US009277336B2

(12) United States Patent
Møller et al.

(10) Patent No.: US 9,277,336 B2
(45) Date of Patent: Mar. 1, 2016

(54) VENTED DOME

(71) Applicants: OTICON A/S, Smørum (DK); BERNAFON AG, Berne (CH)

(72) Inventors: Kenneth Rueskov Møller, Smørum (DK); Patrick Walther, Berne (CH); Nan Jiang, Smørum (DK)

(73) Assignees: OTICON A/S, Smørum (DK); BERNAFON AG, Berne (CH)

( * ) Notice: Subject to any disclaimer, the term of this patent is extended or adjusted under 35 U.S.C. 154(b) by 0 days.

(21) Appl. No.: 14/293,663

(22) Filed: Jun. 2, 2014

(65) Prior Publication Data

US 2015/0003655 A1 Jan. 1, 2015

(30) Foreign Application Priority Data

Jun. 26, 2013 (EP) ..... 13173754

(51) Int. Cl.
*H04R 25/00* (2006.01)

(52) U.S. Cl.
CPC ..... *H04R 25/652* (2013.01); *H04R 25/654* (2013.01); *H04R 2225/021* (2013.01); *H04R 2225/63* (2013.01); *H04R 2460/05* (2013.01); *H04R 2460/11* (2013.01)

(58) Field of Classification Search
CPC .... H04R 25/656; H04R 1/1016; H04R 25/65; H04R 25/654; H04R 25/652; H04R 2225/021
USPC ..... 381/312, 328–330
See application file for complete search history.

(56) References Cited

U.S. PATENT DOCUMENTS

| | | | | |
|---|---|---|---|---|
| 4,972,488 | A * | 11/1990 | Weiss et al. | 381/325 |
| 8,774,435 | B2 * | 7/2014 | Ambrose et al. | 381/328 |
| 2006/0050914 | A1 | 3/2006 | Urso et al. | |
| 2008/0123889 | A1 | 5/2008 | Caldarola | |
| 2008/0152178 | A1 * | 6/2008 | Topholm et al. | 381/330 |
| 2008/0226114 | A1 | 9/2008 | Thompson et al. | |
| 2008/0253598 | A1 * | 10/2008 | Nielsen et al. | 381/330 |
| 2010/0020993 | A1 * | 1/2010 | Poh | 381/314 |
| 2010/0086157 | A1 * | 4/2010 | Feeley et al. | 381/324 |
| 2010/0098281 | A1 | 4/2010 | Urso et al. | |
| 2013/0101147 | A1 * | 4/2013 | Kraemer | 381/322 |

FOREIGN PATENT DOCUMENTS

| | | | |
|---|---|---|---|
| EP | 1 058 479 | A2 | 12/2000 |
| JP | 8-37697 | A | 2/1996 |
| WO | WO 99/07182 | A2 | 2/1999 |

OTHER PUBLICATIONS

European Search Report issued in EP 13173754.6, dated Nov. 8, 2013.

* cited by examiner

*Primary Examiner* — Paul S Kim
*Assistant Examiner* — Norman Yu
(74) *Attorney, Agent, or Firm* — Birch, Stewart, Kolasch & Birch, LLP

(57) ABSTRACT

A hearing device includes a BTE unit and a thin acoustic tube. The BTE unit includes a microphone, an amplifier, a power source, and a receiver and is configured to mount behind or on a user's ear. The tube includes a proximal end and a distal end with the proximal end and the distal end being connected to the receiver and to a flexible mounting insert respectively. The insert comprises a dome shape part and at least one core hole permeable for sound transmitted from the tube, which is configured to arrange in a user's ear canal to transmit sound generated by the BTE unit to a tympanic membrane of the user. The inserts diameter is adapted to at least have the same diameter as user's ear canal diameter to close the ear canal of the user and has at least one internal vent pathway located on the circumference of the core hole.

20 Claims, 16 Drawing Sheets

VENTED DOME

FIELD OF THE INVENTION

The present invention concerns a hearing device comprising a BTE (Behind-The-Ear) unit, which is adapted to be mounted behind or on the ear of a user and further comprising a thin acoustic tube connected to a flexible mounting insert, which comprises a dome shape part and at least one hole for venting.

DESCRIPTION OF RELATED ART

Hearing devices are generally characterized by the way they are fitted to the ear of a user. The BTE type hearing device is mounted behind or on the ear of a user and comprises a BTE unit and a thin tube, where the BTE unit comprises a microphone, an amplifier, a power source and a receiver (speaker). The BTE unit is connected to the thin tube with a distal end of the tube fitted in the ear canal of a user, which transmits sound from the BTE unit or a speaker unit (receiver unit) at the end of the thin tube to the tympanic membrane in the ear canal of the user. A description on various other types of hearing devices can for example be found in US 2008/0123889 A1 and references therein.

Hearing devices generally suffer from various acoustic effects, e.g. the interference of hearing device generated sound and natural sound reaching the tympanic membrane of a hearing device user or direct acoustic feedback, which is a consequence of hearing device generated sound to be reflected from the walls of the ear canal to the microphone of the hearing device leading to sound oscillations. These effects can be suppressed by closing the ear canal of a hearing device user, which effectively prevents natural sound to reach the tympanic membrane and hearing device generated sound to reach the microphone of the hearing device. Closing the ear canal, however, generates an occlusion effect, which corresponds to the amplification of a person's own voice when the person's ear canal is blocked. The amplification in the occlusion effect is a result of reverberating bone-conducted sound vibrations off the object/hearing device filling the ear canal towards the tympanic membrane, as the vibrations cannot escape through the ear canal.

To prevent the occlusion effect a known technique is to introduce a hole for venting in the hearing device part that fills the ear canal. The common vent design is made by adding a vent hole through a dome, which is connected or part of the hearing device with the vent hole diameter and its length having a large impact on the direct acoustic feedback and the occlusion effect.

A common dome is produced by addition of a hot fluidic material into tooling forms, which forms a dome through a hardening process. This method limits the design freedom of the dome, as the holes for sound transmission and venting have to be formed through long and thin tooling forms which are vulnerable due to their high length and small diameter.

Another problem regarding vent holes or small holes in general is the risk of occlusion with ear wax, which can change or remove the effect of the vent or reduce the transmission of sound, as the vent and the core hole for the sound transmission can be filled with ear wax. Further the introduction of a vent hole requires extra material, as the hole needs a canal with a certain length to function properly, otherwise the hole is likely to be closed due to squeezing of the dome in the ear canal, which limits the smallest possible dome size.

JP 8-37697 (A) presents an earplug comprising an earplug main body and a connection member. The earplug main body comprises a base hole that can be used as a vent. The connection member contains four through-holes at a flange part. If the earplug main body and the connection member are connected and their holes are not aligned the earplug is turned to a state where no vent is formed. A vent can be attained if one of the through holes of the flange part is aligned to the base hole of the earplug main body.

In US 2008/0226114 A1 an adapter for use with sound devices is presented. The adapter includes an adapter body with a projection extending from a wall of the adapter body. A sleeve that extends into an ear canal of a user is attached to the projection. The adapter body includes one or more orifices extending through the wag of the adapter. The Sleeve may include a thin layer of a sound transmitting material or scrim.

US 2008/0123889 A1 shows a hearing aid device adapted for use within the ear canal of CIC (Completely-In-The-Canal) and of the partially exposed ITC (In-The-Canal) type. The hearing aid device consists of a system of integrated parts that allow air passages to communicate with the inner ear while the aid is in the ear canal. The hearing aid case is smaller than the wearer's ear canal to form an open passageway between the case and the ear canal. A flexible mounting insert comprises openings to create a sound path extending from the tip of the hearing aid device through the open passageway.

US 2010/098281 A1 presents a multi seal system for retaining a hearing device within a bony portion of an ear canal comprising at least two seals with one having a curved shell with an opening at the apex portion of the shell. A vent can be positioned near or in the opening. The shell has an interior surface wall with scalloped shape to support the shell in conforming to the ear canal and to maintain an acoustical seal in this way. The first seal can center a first device component at a first location in the ear canal and the second seal can center a second device component at a second location in the ear canal.

WO 99/07182 A2 presents an acoustic coupler detachably secured to a receiver assembly for deep insertion into an ear canal. The acoustic coupler provides a semi-rigid, thin walled, cylindrical coupling sleeve adapted to be attached over the cylindrical receiver assembly. A conforming sealing material is attached to the coupling sleeve, which is used to seal the ear canal acoustically. The sealing material can include a venting pathway. A ball joint can allow the receiver assembly to achieve articulation. A lubricous coating or a coating with medicinal properties can be applied on the sealing material. The receiver assembly can comprise a debris guard.

The present invention provides an improved hearing device.

SUMMARY OF THE INVENTION

The present invention provides a hearing device comprising a BTE (Behind-The-Ear) unit and a thin acoustic tube. The BTE unit comprises a microphone, an amplifier, a power source and a receiver (speaker) and is configured to be mounted behind or on the ear of a user. The thin acoustic tube has a proximal end and a distal end. The proximal end of the thin acoustic tube is connected to the receiver of the BTE unit and the distal end is connected to a flexible mounting insert. The flexible mounting insert comprises a dome shape part and at least one core hole permeable for sound transmitted from the thin acoustic tube. The thin acoustic tube is configured to be arranged in a user's ear canal to transmit sound generated by the BTE unit to a tympanic membrane of the user. The mounting insert's diameter is adapted to at least have the same diameter as a ear canal diameter of a user to close the ear canal of the user. Furthermore the mounting insert comprises at least one internal vent pathway, which is located on the circumference of the core hole of the flexible mounting insert.

One aspect of the invention is to reduce the occlusion effect by integrating a vent pathway in the core hole. Another aspect is the reduction of the acoustic feedback effect by using an acoustic tube to transmit the sound from the BTE unit to the ear canal, as backscattered sound does not reach the microphone of the hearing device and the backscattering is reduced by the vent pathways in the core hole. Further a comfortable fit in the ear canal is provided, as the mounting insert which adjoins to the ear canal is made of a flexible material. The design of the vent pathway allows to produce smaller dome sizes with the need of less material. The vent pathway size can be adjusted to the user needs increasing the design freedom of the mounting insert. Further the vent pathway is less likely to be blocked through squeezing of the mounting insert in the ear canal. Another aspect of the invention is that the vent pathway is less prone to be blocked with ear wax, as it is part of the core hole, which reduces the need for cleaning the device.

The sound transmitting core hole of the mounting insert can also partly contain a sound impermeable material, e.g. sound filter elements like gratings or sieves with small holes which transmit the sound. There can also be a number of gratings or sieves consecutively arranged in the core hole, whose holes do not necessarily have to be aligned and which can be used to control the sound transmission and the vent pathway size.

The vent pathway on the circumference of the core hole may be a groove in the material. Also a larger number of grooves can be arranged on the perimeter of the core hole. The grooves can be arranged on the whole circumference, preferably they only occupy a maximum of 340° of the circumference, such as a maximum of 300°, respectively preferred 180° of the circumference of the core hole. The size of the grooves can be designed in dependence of the needs of a user, with larger grooves for higher venting pathways. The form of the grooves can be cylindrical, cubical or of a similar geometric form.

The vent pathway can start at the distal end or the proximity of the distal end of the thin acoustic tube and end at a proximal end of the flexible mounting insert or a proximal end of a projection of the flexible mounting insert or in the proximity of the proximal end of a projection of the flexible mounting insert, which encloses the vent pathway. The length of the vent pathways can be shorter if squeezing of the mounting insert is expected to be smaller and longer for stronger squeezing of the mounting insert.

A wax filter element adapted to be at least partly permeable for sound transmission and at least partly impermeable for material transmission can be placed in front of the core hole or inside of the core hole to stop ear wax to enter the core hole and damp sound reflected from the ear canal. Preferably the wax filter element is coated with a material or has a specialized surface form that dampens sound to increase the sound dampening effect. In one embodiment the wax filter element has a grating with a fine mesh to stop wax from entering the core hole. The grid size can be varied to adjust the dampening and ear wax filtering effect. An alternative embodiment includes a filter bridge that is preferably located in front of the core hole or in close proximity to the core hole and shields the core hole from ear wax.

One aspect of the invention is therefore to prevent ear wax to close the vent pathway, as the wax filter element guards both the sound transmission core pathway through the core hole as well as the vent pathway due to the arrangement of the wax filter element and the vent pathway, e.g. in the core hole.

In a preferred embodiment the distal end of the thin acoustic tube is a ball joint with a hole for sound transmission and a spherical shape, which is adapted to adjoin to the flexible mounting insert. The spherically shaped distal end of the thin acoustic tube can act as a tread to form a stable connection to the flexible mounting insert.

Preferably the flexible mounting insert comprises at least two materials. The innermost material of the mounting insert is preferably the hardest of the materials, intended to adjoin to the acoustic tube and the outermost material is the most flexible and soft material, intended to adjoin to an ear canal of a user. In one preferred embodiment the hardest and innermost part of the flexible mounting insert adjoins to the spherically shaped distal end of the acoustic tube respectively it adjoins to the ball joint. The innermost part of the flexible mounting insert preferably contains the vent pathways on its circumference. The flexible mounting insert adjoined to the ball joint can have an increased articulation and is able to better adapt to the form of the ear canal, allowing an angle between the acoustic tube and the flexible mounting insert adjoined to the acoustic tube.

The flexible mounting insert connected to a ball joint with venting pathways in the innermost art of the flexible mounting insert which adjoins to the ball joint is in itself an invention that can also be implemented in other hearing devices without the need of an acoustic tube. Preferably a thin tube with an electrical lead connecting the BTE unit and a speaker unit (receiver unit) can be used instead of the acoustic tube, wherein the distal end of the speaker unit forms the ball joint or is connected to the ball joint. The receiver of the hearing device can for example be housed in the speaker unit and the lead transmits signals from the amplifier of the BTE unit to the receiver located in the ear canal.

In another embodiment the flexible mounting insert and/or the acoustic tube can include sound pressure level sensors on their distal sides, where distal means the side in the direction of the ear canal. The sensors are adapted to measure a sound pressure level on on the distal side. Also other sensors are possible, which measure other parameters of the acoustic environment. The hearing device can also include sensors on the proximal side, which is the side in the direction away from the ear canal to the outside of the ear. The proximal sensors can measure parameters of the acoustic environment on the outside of the ear. A processing unit can then determine the difference between the parameters of the acoustic environments on the distal and proximal sides of the mounting insert to generate a control signal or save the data in a memory unit.

In a preferred embodiment the core hole has an entrance area in the dome shape part of the flexible mounting insert. The entrance area can include filter element, e.g. a sound filter element. In one embodiment the sound filter element is comprised of consecutively arranged filter elements. Preferably the filter element includes mechanical or micromechanical means for rotation of individual filter elements of the sound filter element.

In another embodiment at least part of the material of the flexible mounting insert and/or a part of the material at the proximity of the distal end of the thin acoustic tube comprise piezoelectric properties. Applying a current to the material parts with piezoelectric properties can lead to a volume increase of the material, which for example decreases the size of the venting pathway. The piezoelectric materials can also be used to rotate the consecutively arranged filter elements, e, g, gratings, sieves or similar filters, to each other, leading to a misalignment of the filters, which can lead to a decreased sound transmission or decreased venting effect, as smaller transmission area is available for sound to be transmitted from the ear canal to the outside of the ear.

Preferably the processing unit is connected to the sensors that monitor the acoustic environment. The processing unit can generate control signals in dependence of the difference between the parameters of the acoustic environments on the distal and proximal sides of the mounting insert. The control signals can be transmitted to the mechanical, micromechanical or piezoelectrical means, which are configured to increase or decrease the venting pathway and the sound transmission by rotation of filter elements and expansion or contraction of the material with piezoelectric properties to optimize the sound experience of a user.

In another embodiment the wax filter element is at least partly of a material with piezoelectrical properties. Preferably at least the grating of the wax filter element has piezoelectrical properties. The wax filter element can also be connected to the processing unit which is connected to the sensors that monitor the acoustic environment and controls the size of the venting pathways. Applying current to the wax filter element can increase or decrease the sound transmission by increasing or reducing the size of the holes in the wax filter element, which further allows to control the possible amount of ear wax or fluid that enters through the filter.

According to an alternative embodiment instead of the thin acoustic tube a lead connecting the amplifier of the BTE unit with the receiver is provided. The receiver is configured to be arranged in a user's ear canal to transmit signals generated by the amplifier to the receiver. The receiver is enclosed in a receiver unit which is configured to be connected to the flexible mounting insert. The receiver is configured to generate sound to be transmitted to a tympanic membrane of the user. In a preferred embodiment, a ball joint forms the distal end of the receiver unit or is connected to the distal end of the receiver unit, and the ball joint has a hole for sound transmission and a spherical shape, which is adapted to adjoin to the flexible mounting insert.

BRIEF DESCRIPTION OF ACCOMPANYING FIGURES

The present invention will be more fully understood from the following detailed description of embodiments thereof, taken together with the drawings in which:

FIG. 1 shows a schematic illustration of a human ear with a hearing device with a BTE (Behind-The-Ear) unit connected to an acoustic tube that is connected to a mounting insert that adjoins to the ear canal of the human ear, FIG. 1A shows an ITE (In the Ear) unit, where the acoustic tube is very short and FIG. 1B shows the ITE unit where the acoustic tube is very short, such that the microphone, sound processor and battery are all seated inside the ear canal according to an embodiment of the invention;

DETAILED DESCRIPTION OF THE INVENTION

Figure 1:
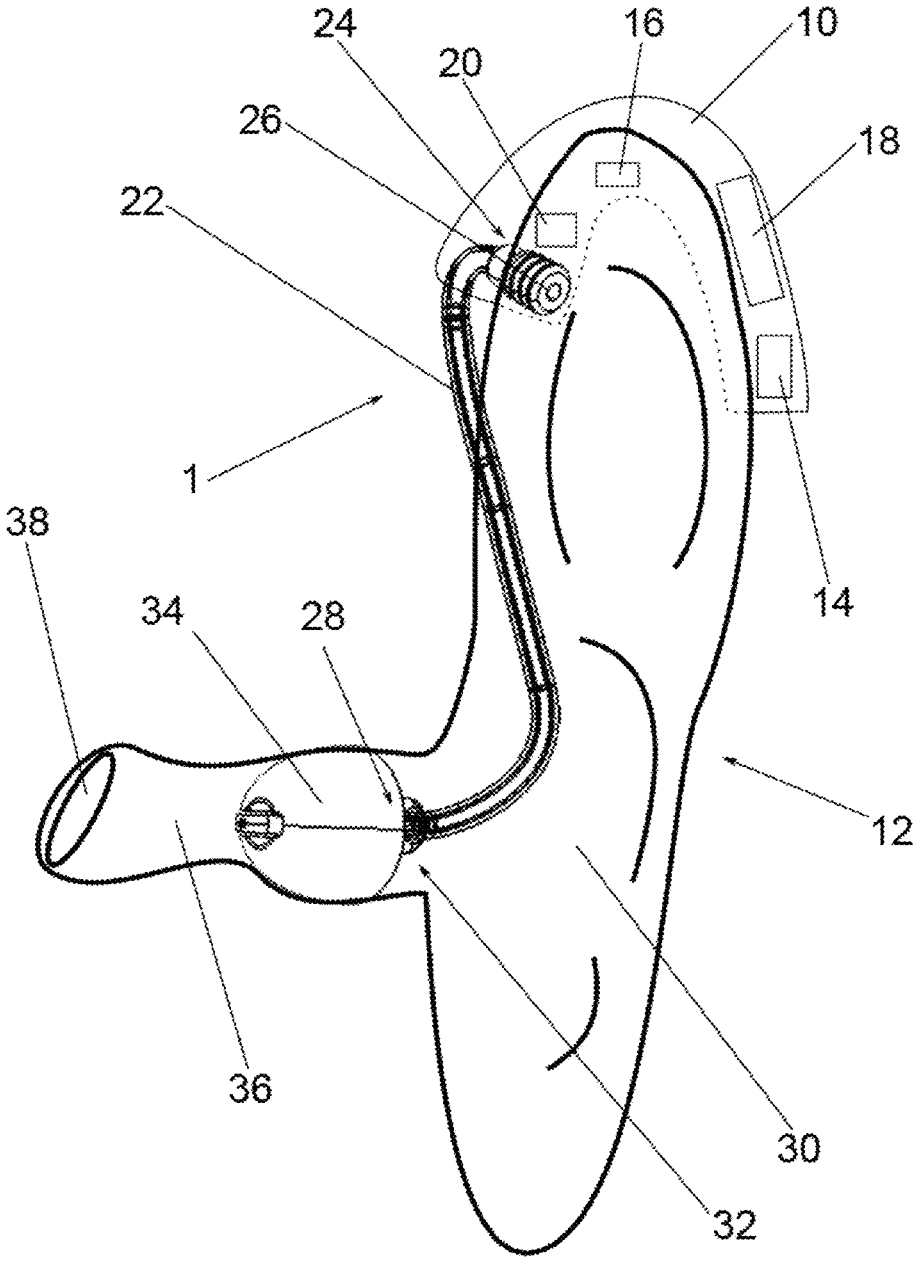

FIG. 1 shows a hearing device 1 with a Behind-The-Ear (BTE) unit 10 mounted on an ear 12 of a user. The BTE unit 10 has a microphone 14, an amplifier 16, a power source 18 and a receiver 20. The microphone 14 records sound and generates electrical signals, which are amplified in the amplifier 16 and transmitted to the receiver 20. The receiver 20 uses the amplified electrical signals to generate sound, which is guided to an acoustic tube 22, which has a proximal end 24 connected to the BTE-unit 10 by an acoustic plug 26 and a distal end 28. The acoustic tube 22 runs along the form of the ear 12 through the concha 30 into an ear canal 32 of a user. The sound generated by the receiver 20 in the BTE unit 10 is transmitted through the acoustic tube 22 to a mounting insert 34 which adjoins to the distal end 28 of the acoustic tube 22. The mounting insert 34 is adapted to adjoin to the ear canal 30 of the user, where the sound enters a cavity 36 and finally reaches a tympanic membrane 38 of the user.

Figure 1A:
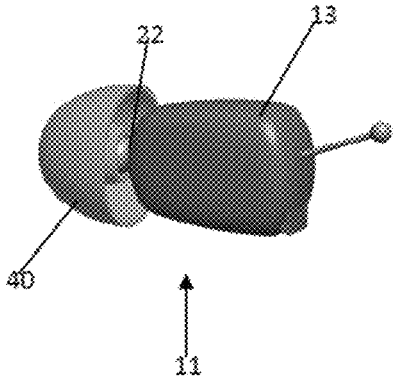
Figure 1B:
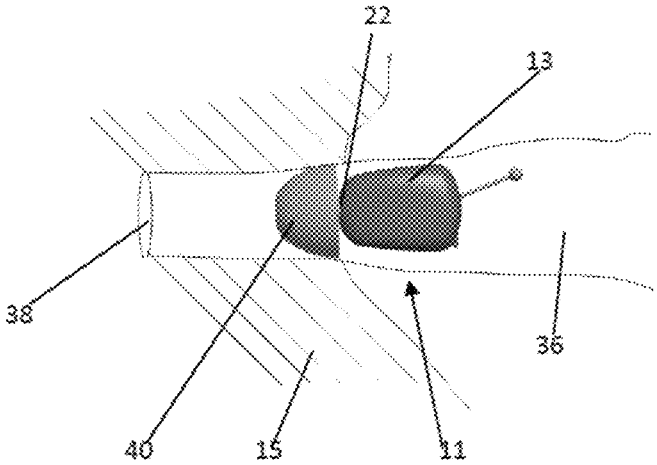

FIGS. 1A and 1B shows an ITE (In the Ear) unit, where the acoustic tube 22 is very short, such that the microphone, sound processor and battery are all seated inside the ear canal 36 as seen in FIG. 1B. All the venting problems and solutions presented below with respect to the RITE, and BTE solutions will also apply to ITE solutions as presented in FIGS. 1A and 1B. In FIG. 1B the ITE has its dome shaped part 40 placed in the bony part 15 of the ear canal 36, and here the venting problems may differ slightly from the venting problems of dome shaped parts placed outside of this bony part. Firstly, the vent will usually have to be smaller, and secondly it is most important that the vent canal is open when the hearing aid 11 is inserted or pulled out, as otherwise the tympanic membrane 38 may be subject to higher than ambient or lower than ambient pressures as the domes shaped part travels the length of the bony section in the same way a piston travels the length of a cylinder. This may cause pain or injury to the person wearing the hearing aid 11.

Figure 2:
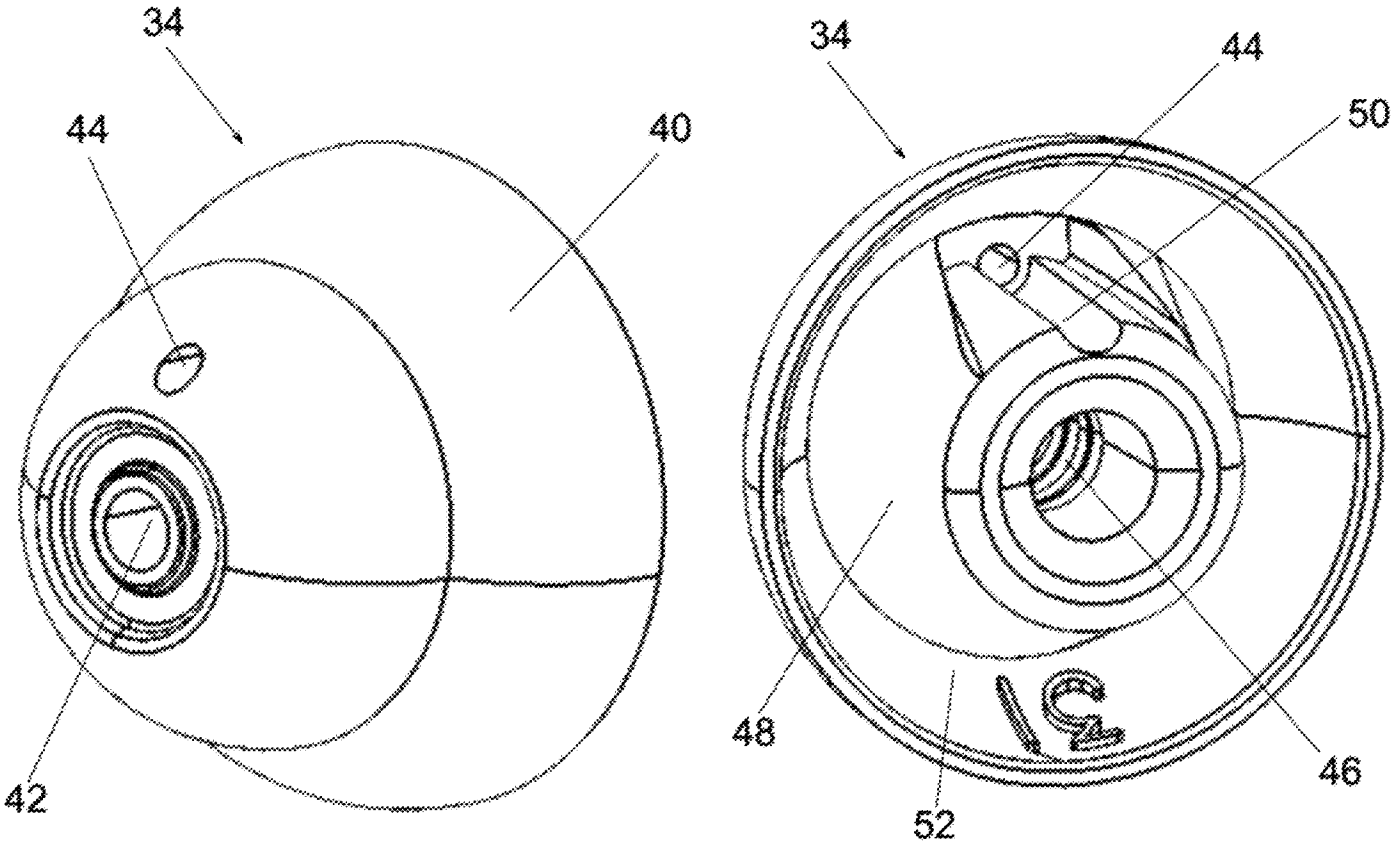
FIG. 2 shows a schematic illustration of prior art vented domes with a venting hole in two perspectives.

FIG. 2 shows a prior art mounting insert 34 with a dome shaped part 40 that has a core hole 42 and a vent hole 44. The Gore hole 42 is the entrance to a core pathway 46 which is enclosed by a core pathway projection 48. The core pathway 46 is mainly used to transmit sound. The vent hole 44 is in front of a venting slit 50, both being part of the vent pathway, which is intended to equalize pressure in the inside and outside of the ear canal cavity 36. A mounting insert cavity 62 allows the dome shaped part 40 to adjust to the ear canal 32 through squeezing of the dome shaped part 40 in the direction of the core pathway projection 48.

Figure 3:
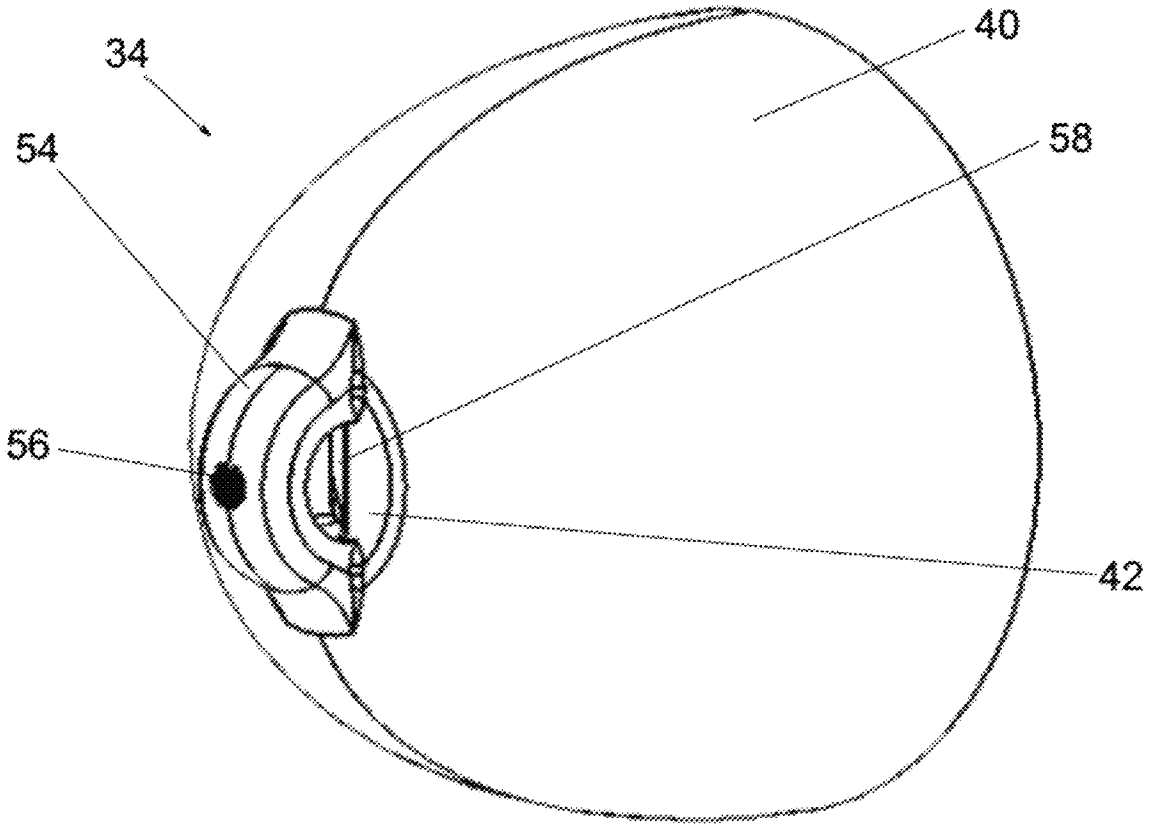
FIG. 3 shows a schematic illustration of a mounting insert with dome shape and a filter bridge element in front of its core hole according to an embodiment of the invention.

FIG. 3 presents a first embodiment of a flexible mounting insert 34 with a filter bridge 54 in front of the core hole 42 intended as a wax filter. The filter bridge 54 of this embodiment contains a small filter bridge hole 56 and is affixed to the dome shaped part 40 of the flexible mounting insert 34 with a filter bridge affixture 58. Sound can pass either through the filter bridge hole 56 or through an indirect pathway along the sides of the filter bridge 54 into the core hole 42. Ear wax is stopped by the filter bridge 54, as the ear wax is too large to pass neither the filter bridge hole 56 nor the indirect pathway along the sides of the filter bridge 54 into the core hole 42.

Figure 4:
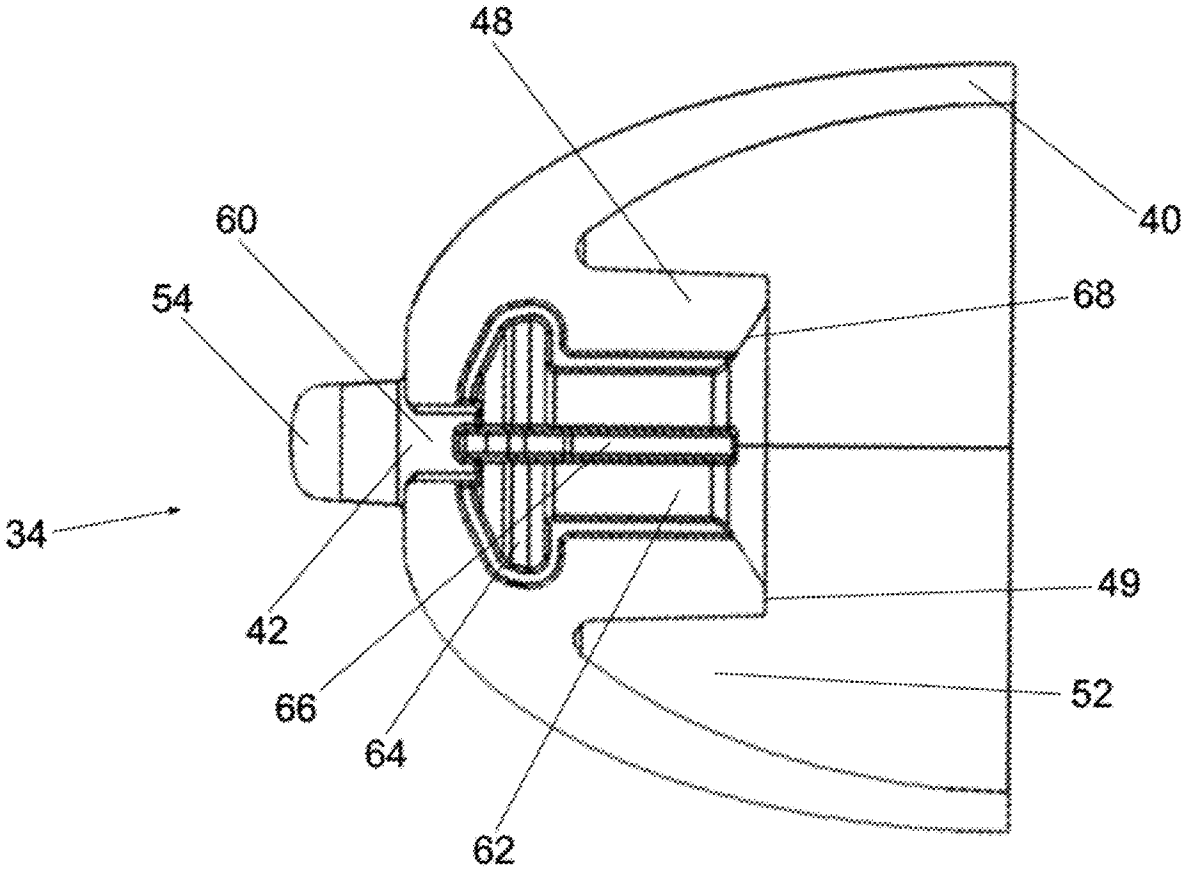
FIG. 4 shows a longitudinal cut through the mounting insert of FIG. 3 with details of the venting pathway according to an embodiment of the invention.

FIG. 4 is a longitudinal cut through the first embodiment of the flexible mounting insert 34. Behind the filter bridge 54 is an entrance area 60 of the core hole 42 which is enclosed and formed by the dome shaped part 40 of the mounting insert 34. The entrance area 60 may contain additional filter elements (not shown). The entrance area 60 adjoins to a cavity 62 adapted to enclose the acoustic tube 22. A tread cavity 64 with a larger diameter than the cavity 62 for the acoustic tube 22 is intended to fasten the acoustic tube 22 in the mounting insert 34. The acoustic tube 22 contains the core pathway 46 which is intended to transmit sound from the receiver 20 of the BTE-unit 10 to the tympanic membrane 38 in the ear canal 32 (not shown). The cavity 62 contains vent grooves 66, which are intended as vent pathways, in the material of the perimeter of the cavity 62. The vent grooves 66 extend to an outlet 68 which increases the diameter of the cavity and ends at the proximal end 49 of the core pathway projection 48.

Figure 5:
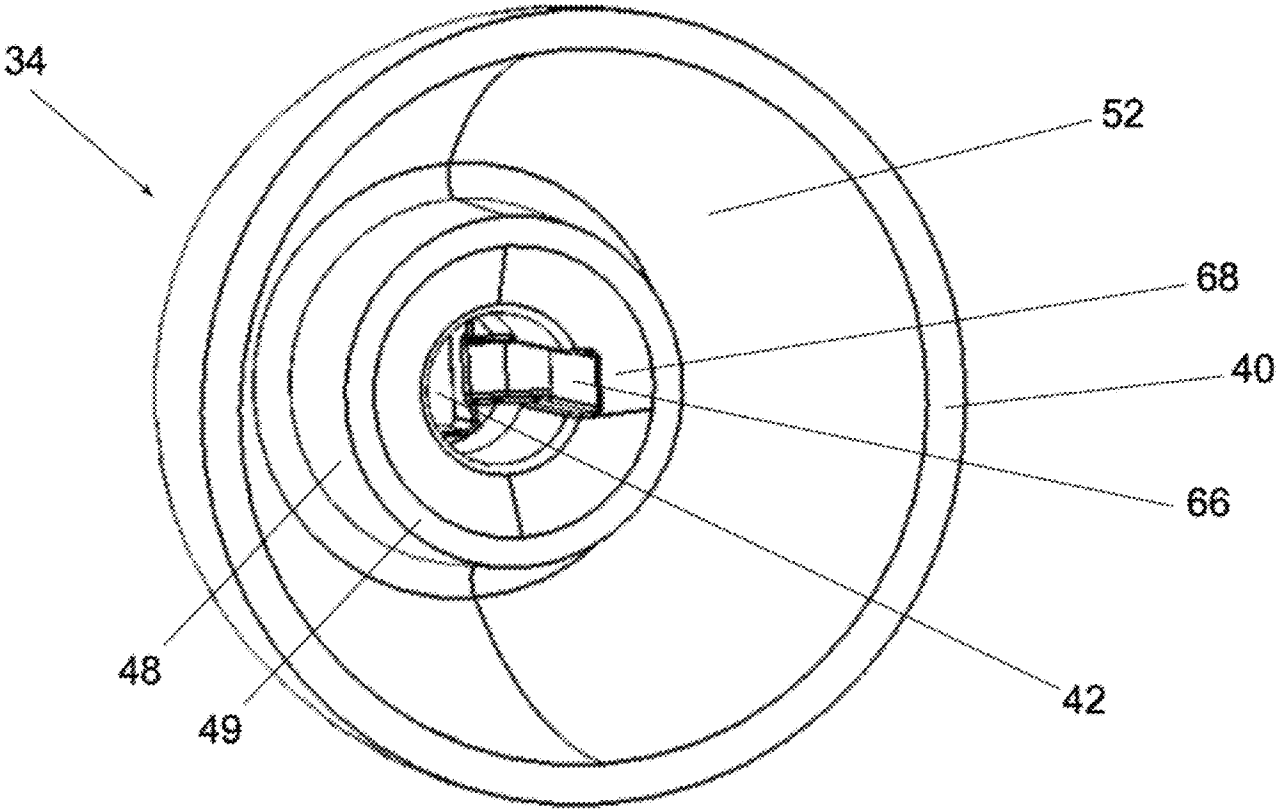
FIG. 5 shows another perspective of an embodiment of a mounting insert with dome shape and one vent groove according to an embodiment of the invention.

FIG. 5 shows a second embodiment of the flexible mounting insert 34 which contains only one vent groove 66 in a box-like form along the circumference of the core hole 42 extending to the outlet 68 which ends with the proximal end 49 of the core pathway projection.

Figure 6:
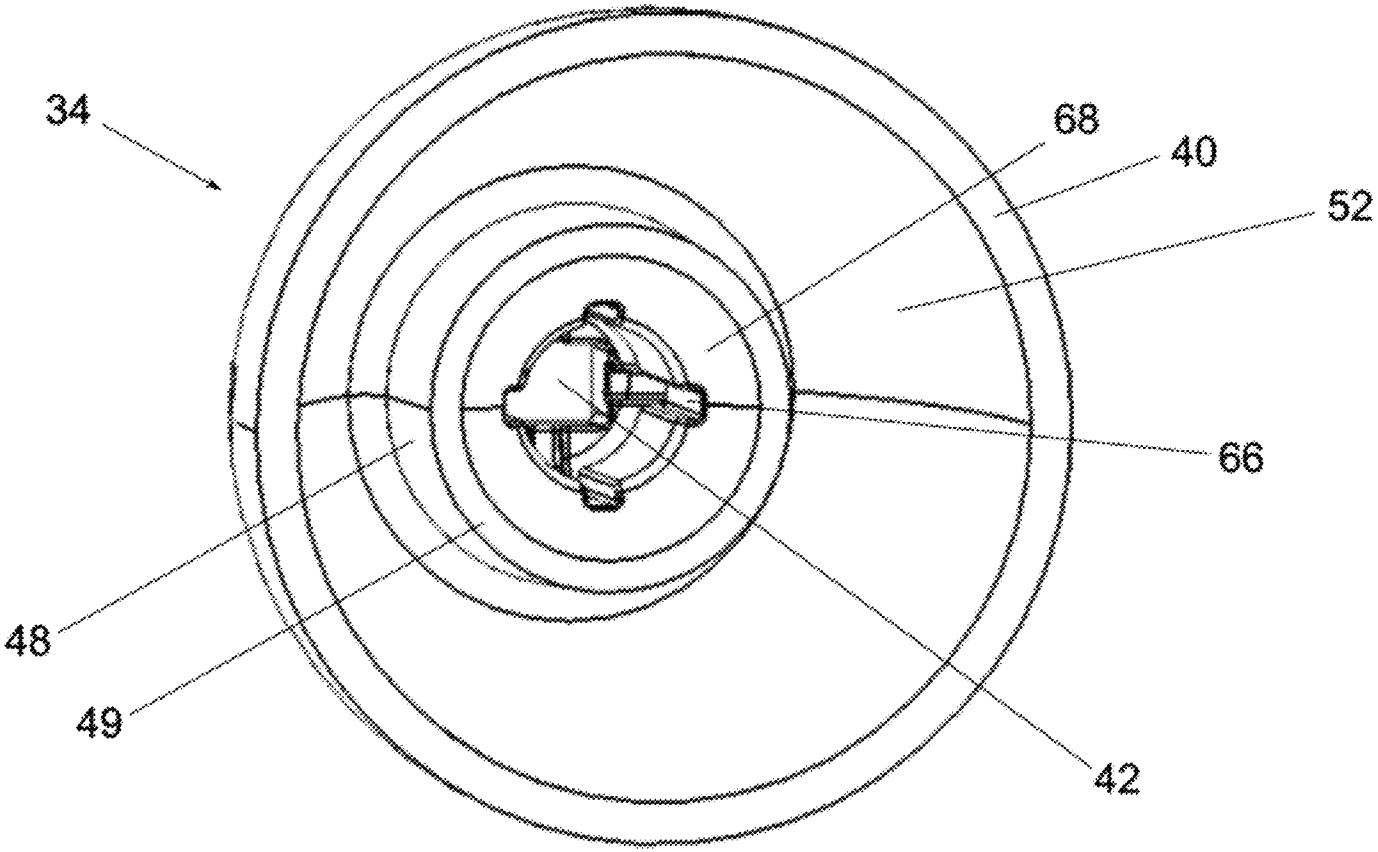
FIG. 6 shows a second embodiment of a mounting insert with dome shape and four vent grooves according to an embodiment of the invention.

FIG. 6 presents a third embodiment of the flexible mounting insert 34 which is almost identical to the second embodiment, but contains four smaller sized box-like vent grooves 66 which are arranged symmetrically around the core hole 42. The vent grooves 66 extend to the outlet 68, which ends at the proximal end 49 of the core pathway projection 48.

Figure 7:
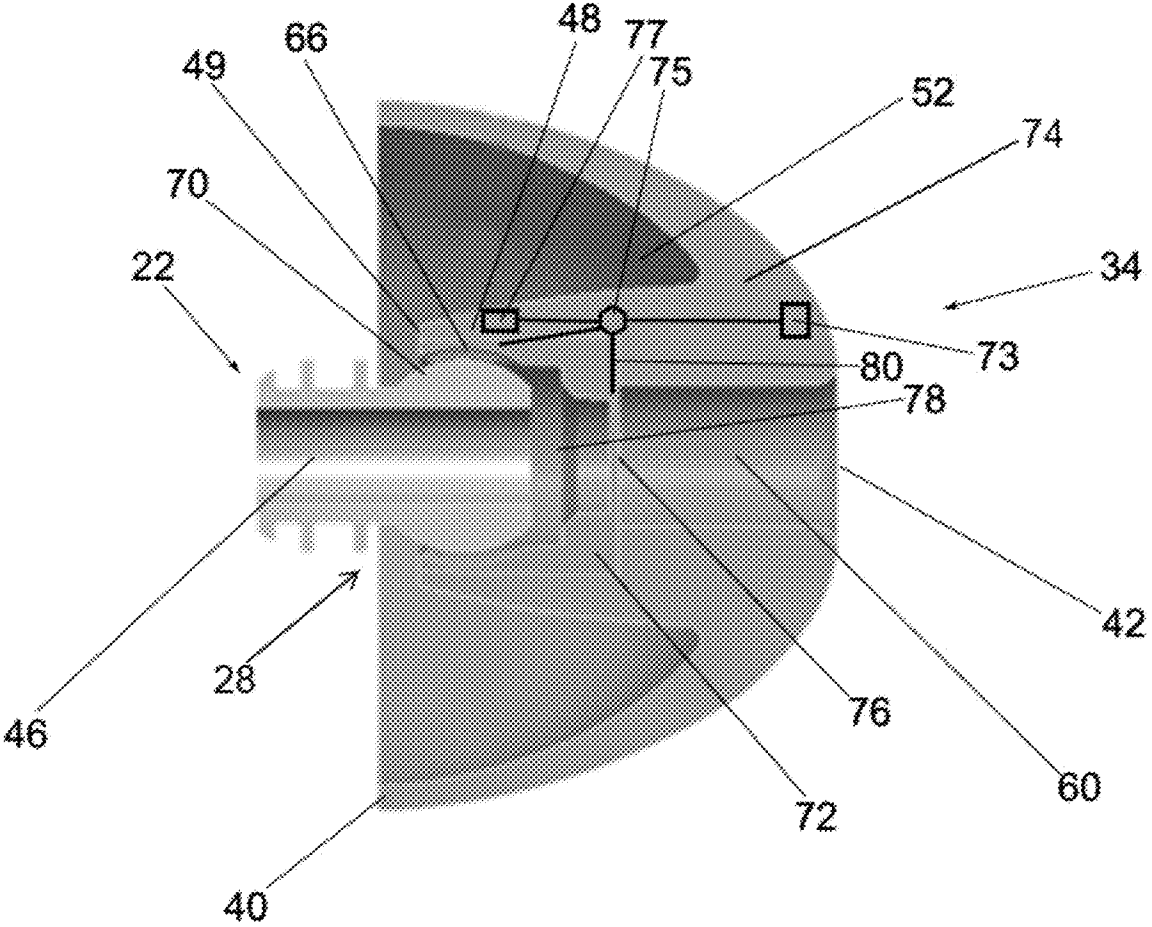
FIG. 7 shows a ball joint connected to another embodiment of the mounting insert with dome shape and vent grooves in a longitudinal cut according to an embodiment of the invention.

In FIG. 7 an acoustic tube 22 with a distal end 28 with a ball joint 70 having a spherical shape is connected to the mounting insert 34. The mounting insert 34 is comprised of two parts, an inner core part 72 which is of a hard material and an outer part 74 which is of a softer and flexible material. The inner core part 72 adjoins to the ball joint 70 which encloses the core pathway 46. Vent grooves 66 are located on the circumference of the inner core part 72 running around the ball joint 70 and end at the proximal end 49 of the core pathway projection 48 creating a vent pathway. As the inner core part 72 is of a harder material it can be clicked on the ball joint 70 creating a stable connection. The inner core part 72 contains a wax filter element 76 between an inner part cavity 78 and the entrance area 60 of the core hole 42. The core hole 42 can contain further filter elements (not shown). The softer material of the outer part 74 enclosing the inner core part 72 is intended to generate a comfortable fit in the ear canal 32 of a user.

As an option a distal sensor 73 is configured to measure parameters of the acoustic environment in the ear canal cavity 36. The parameters are enclosed in an electrical signal and sent to a processing unit 75. The processing unit is further connected to a proximal sensor 77, which measures parameters of the acoustic environment outside of the ear canal cavity 36 and sends these parameters as an electrical signal to the processing unit 75. The processing unit 75 can for example compare the sound pressure levels between the ear canal cavity 36 on the distal side of the flexible mounting insert 34 in and on the proximal side of the flexible mounting insert 34. The processing unit 75 can then e.g. generate an electrical signal from the difference in sound pressure levels and send control signals over the electrical leads 80 to control the size of the vent grooves 66 e.g. by mechanical means such as nitinol wires or piezoelectrical means or the size of the grating 82 (FIG. 8) of the wax filter element 76.

Figure 8:
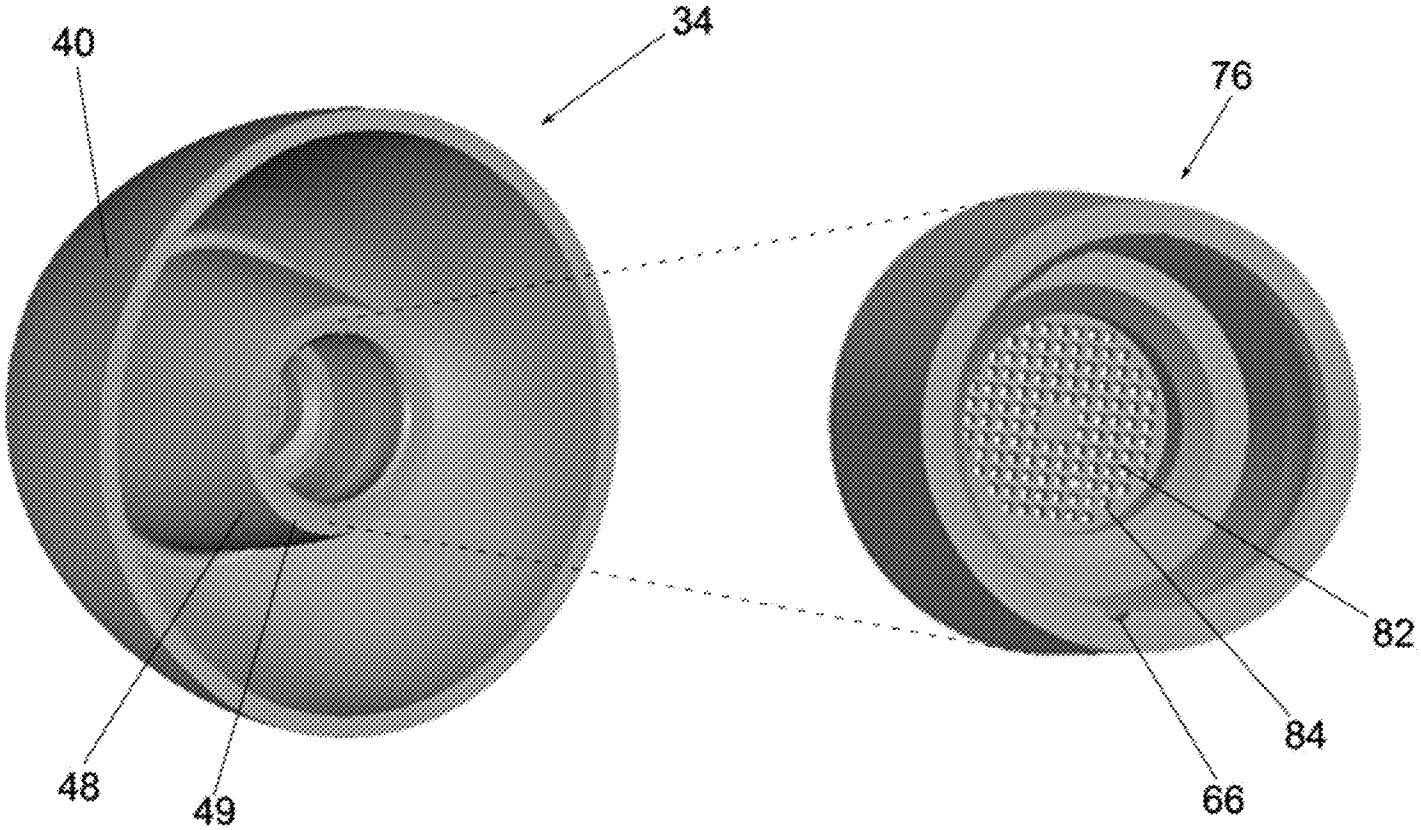
FIG. 8 shows a mounting insert with an inserted wax filter element and details of the wax filter element according to an embodiment of the invention.

FIG. 8 presents a fourth embodiment of the flexible mounting insert 34 which contains a removable wax filter element 76. The wax filter element 76 is located behind the core hole 42 in the core pathway 46 and enclosed by the core pathway projection 48. A wax filter grating 82 has holes 84 that allow passage of sound, while the grating 82 prevents ear wax to enter the core pathway 46 of the mounting insert 34. The wax niter element 76 contains a vent groove 66, which is intended for venting. The vent groove 66 is therefore located behind the wax filter grating 82, which means that the wax filter element 76 protects the core pathway 46 for sound transmission and the vent pathway of the vent groove 66 from becoming blocked by ear wax. Preferably the wax filter grating 82 contains a coating on its distal side oriented into the ear canal, which dampens sound. Also a coating which interacts with ear wax to liquefy the ear wax can be applied on the wax filter element 76.

Figure 9:
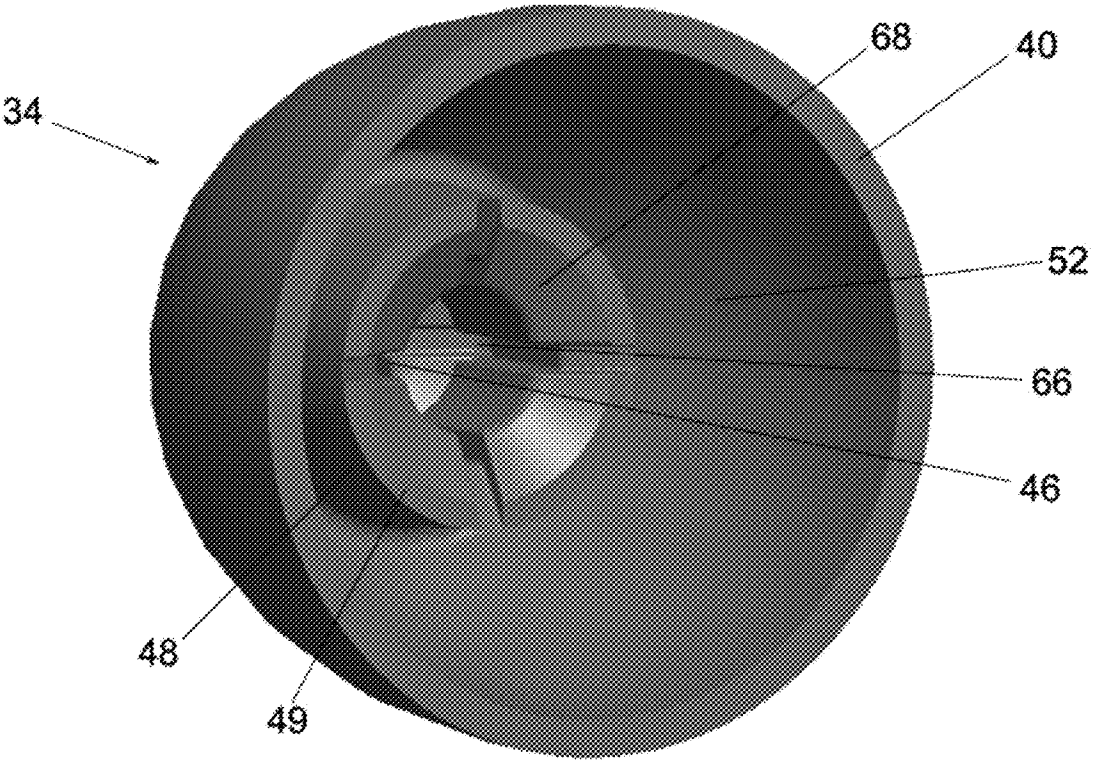
FIG. 9 shows another embodiment of a mounting insert with dome shape and vent grooves in the core hole that elongate to the end of a core pathway projection according to an embodiment of the invention.

FIG. 9 shows a fifth embodiment of the flexible mounting insert 34 which is similar to the third embodiment, with the major difference that the vent grooves 66 are elongated to the proximal end 49 of the core pathway projection 48.

Figure 10:
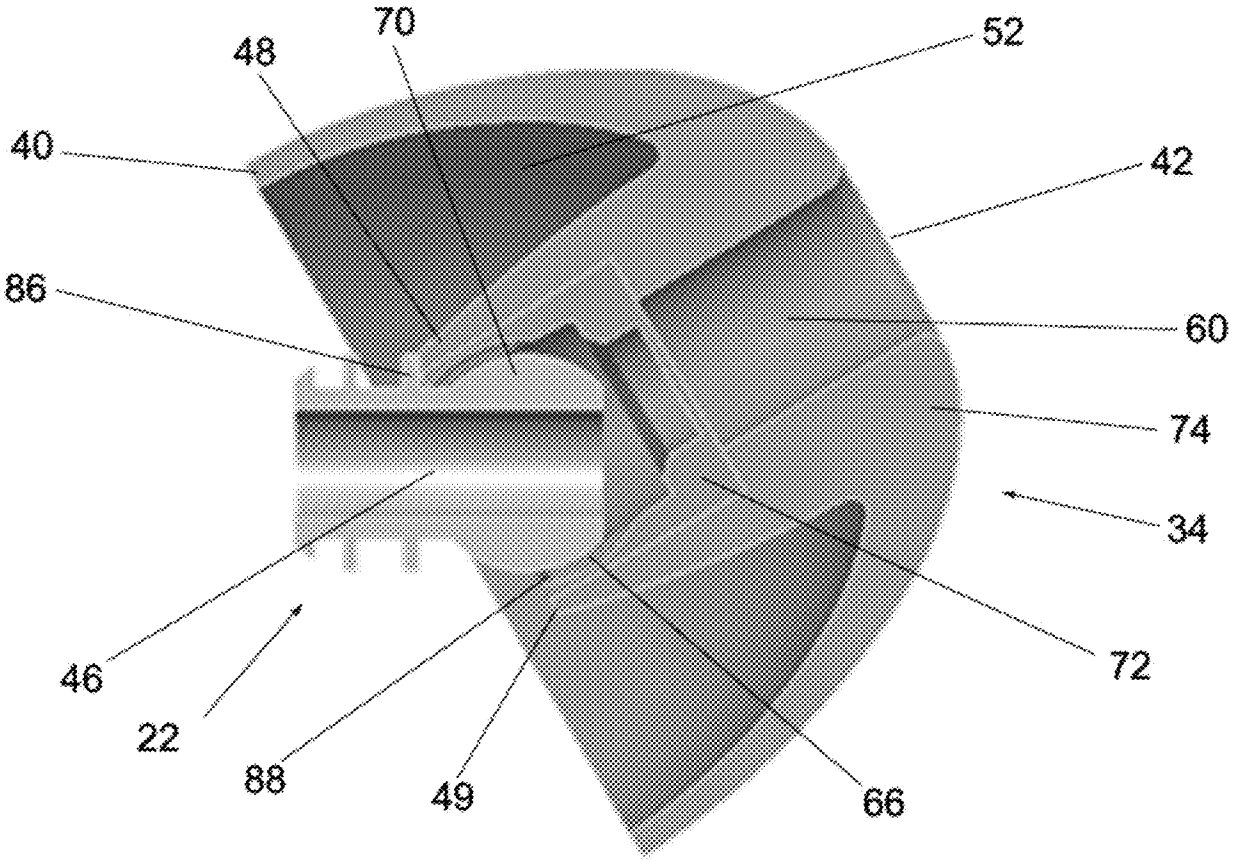
FIG. 10 shows the ball joint connected to the mounting insert of FIG. 7 in angled position according to an embodiment of the invention.

FIG. 10 shows the acoustic tube 22 with ball joint 70 connected to the mounting insert 34 of FIG. 7 in an angled position of the mounting insert 34 with respect to the acoustic tube 22 (without sensors and processing unit). A tread 86 on the outer circumference of the acoustic tube 22, which is located in the proximal vicinity of the spherically shaped ball joint 70 limits the articulation of the flexible mounting insert 34. The core pathway projection 48 is in contact with the tread 86 closing one region of the vent groove 66, while in the other regions a vent groove exit 88 is maintained as a vent pathway.

Figure 11:
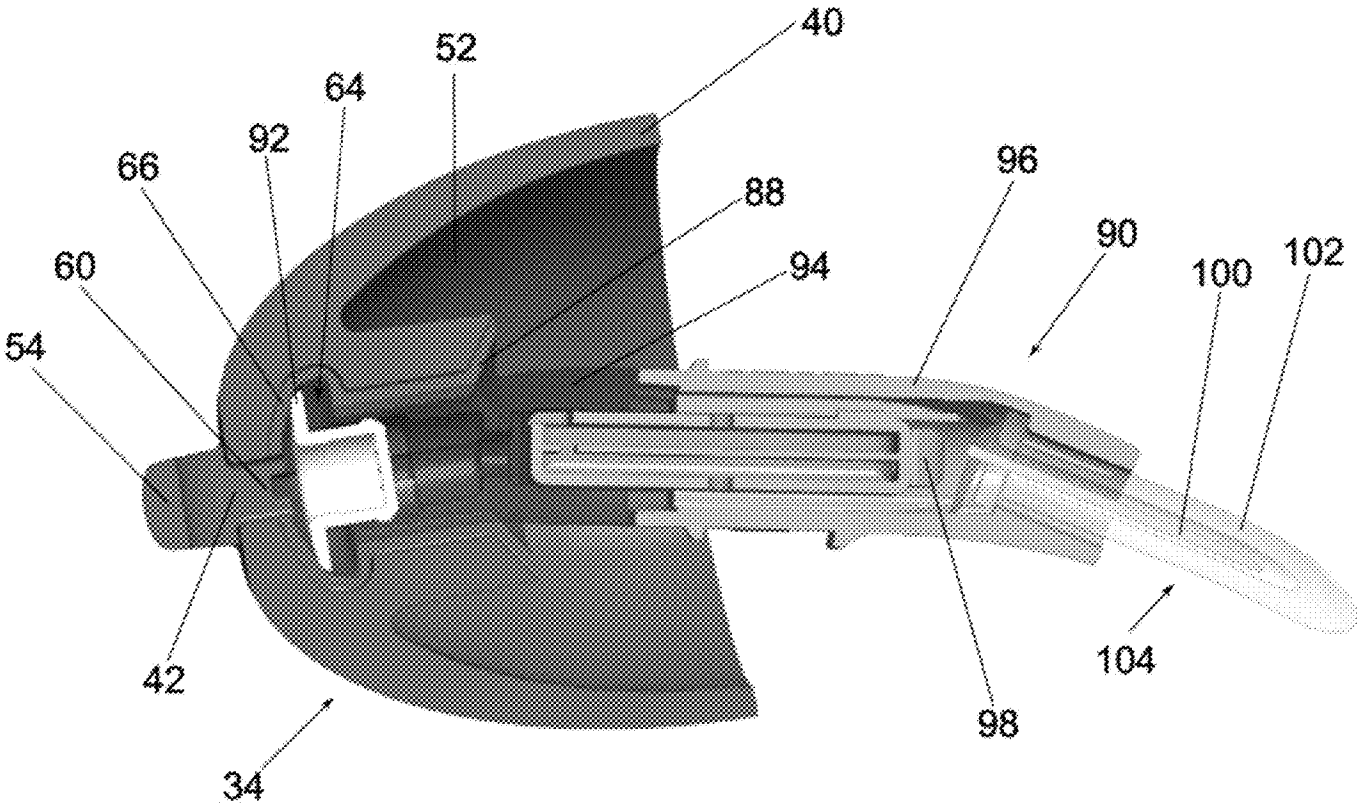
FIG. 11 shows a mounting insert connected to a speaker unit (receiver unit) according to an embodiment of the invention.
Figure 12:
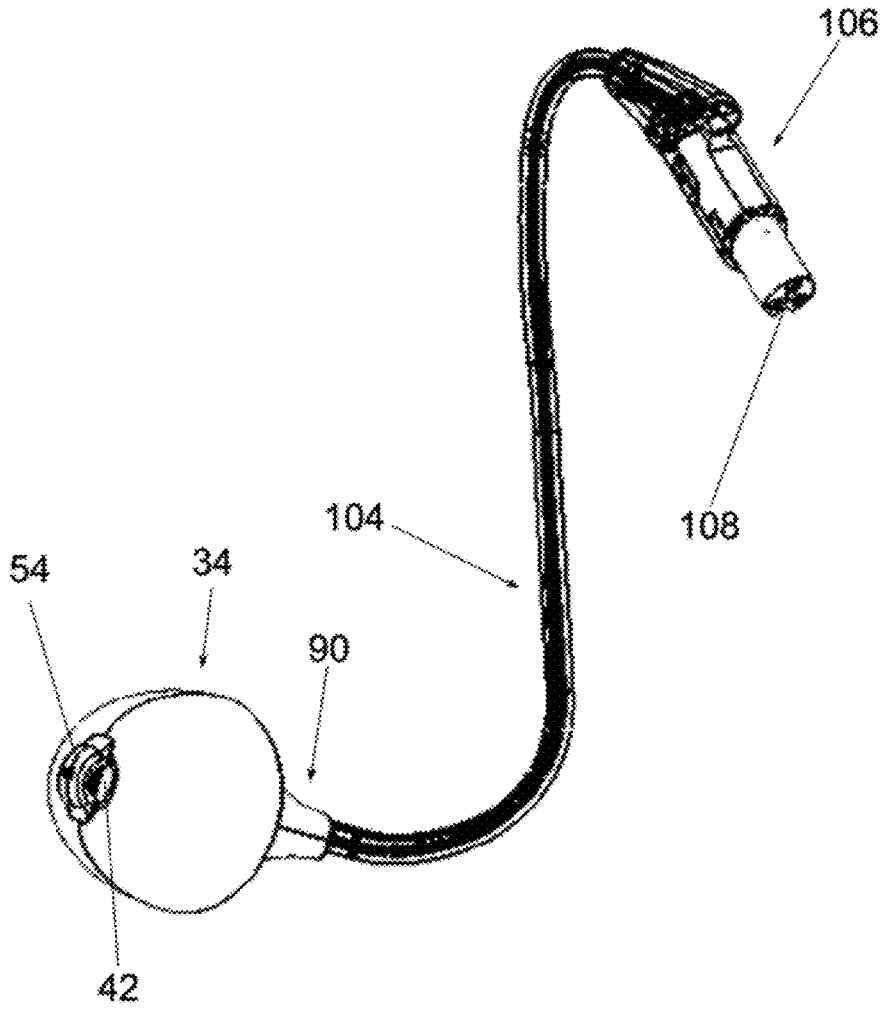
FIG. 12 shows a mounting insert connected to a speaker unit and the cable connection to the BTE unit according to an embodiment of the invention.

FIG. 11 presents a speaker unit (receiver unit) 90 connected to a flexible mounting insert 34. A speaker tread 92 that is enclosed by a flexible speaker connection element 94 is fastened in the tread cavity 64 to form a stable connection between the speaker unit 90 and the flexible mounting insert 34. The speaker tread 92 can also be a ball joint and the flexible mounting insert 34 can be formed from a hard inner core part 72 and a flexible outer part 74 (not shown). The flexible speaker connection element 94 connects to a speaker unit housing 96 which contains a speaker (receiver) 98, which generates sound from electrical signals supplied to the speaker 98 by a wire 100. The wire 100 is enclosed by a sleeve 102, which forms a lead 104. The lead 104 has an electrical plug 106 and connectors 108 which are connected to the BTE unit 10 where the electrical signals are generated from sound recorded by the microphone 14 (see FIG. 12). The distal end of the speaker unit (receiver unit) 90 can also be formed as a ball joint and connect to the flexible mounting insert 34 (not shown).

Figure 13:
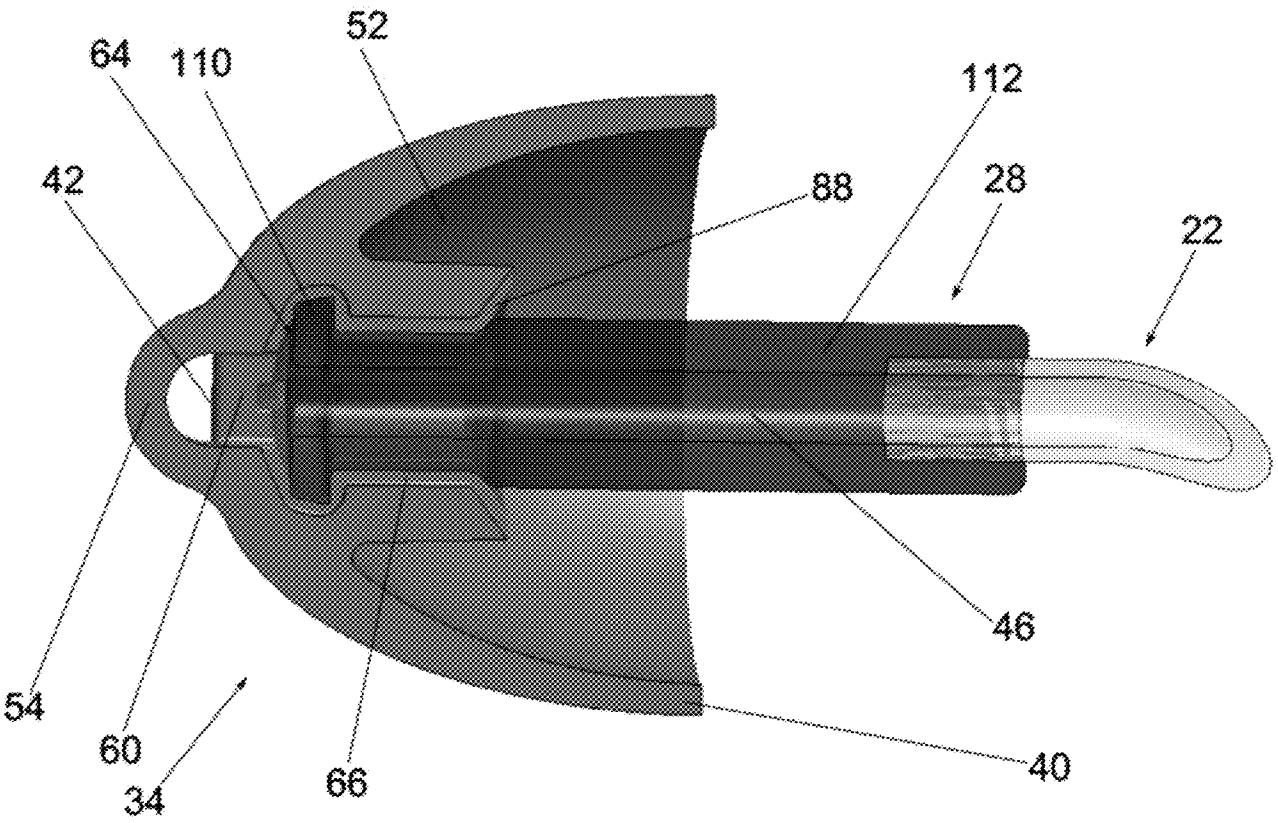
FIG. 13 shows a mounting insert connected to an acoustic tube according to an embodiment of the invention.

FIG. 13 shows a flexible mounting insert 34 connected to an acoustic tube 22. A tread 110 of the acoustic tube 22 is fastened in the tread cavity 54 to form a stable connection between acoustic tube 22 and flexible mounting insert 34. The tread 110 is part of a flexible acoustic tube housing 112 which is connected to the distal end 28 of the acoustic tube 22. Sound generated by the receiver 20 in the BTE unit 10 is transmitted through the acoustic tube 22 along the core pathway 46 to the ear canal 32, where it is received from the tympanic membrane 38 of the user.

Figure 14:
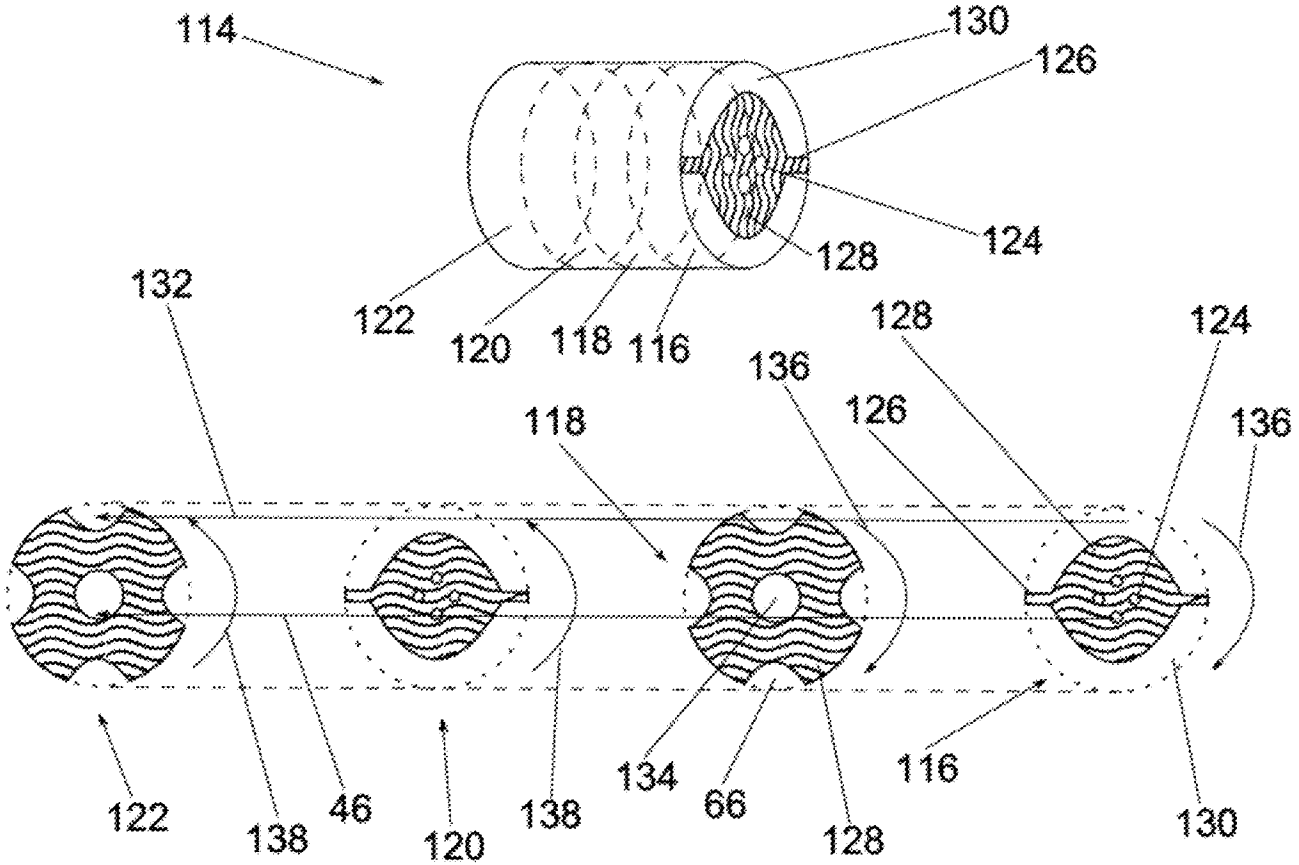
FIG. 14 shows an embodiment of a filter element for the mounting insert according to an embodiment of the invention.

In FIG. 14 a first embodiment of a sound filter element 114 is presented. The sound filter element 114 is comprised of a first filter element 115, a second filter element 118, a third filter element 120 and a fourth filter element 122, which are consecutively arranged. The sound filter element 114 can for example be placed in the entrance area 60 of the core hole 42 to control the amount of sound transmitted through the core pathway 46. The first filter element 115 has small sound transmission holes 124 arranged in the center of the filter element 114 for transmitting sound and bridging elements 125 connected to the core hole 42 walls of the flexible mounting insert 34. A sound damping material forms the core of the filter element 128, which partly blocks the core pathway 46. Large vent holes 130 allow for sound transmission for venting along a vent pathway 132. The second filter element 118 has a large sound transmission hole 134 to allow for sound transmission from the small sound transmission holes 124. Grooves 66 at the circumference of the second filter element 118 allow for venting, while the sound is partly blocked by the filter element core 128. To control the size of the sound transmission along the core pathway 46 and the venting along the vent pathway 132 it is possible to rotate the filter elements 116, 118, 120 and 122, e.g. by mechanical means or piezoelectrical means. The filter elements 116 and 118 are rotated in clockwise direction 136, while the filter elements 120 and 122 are rotated in counter clockwise direction 138 to control the sizes of the core pathway 46 and the vent pathway 132.

Figure 15:
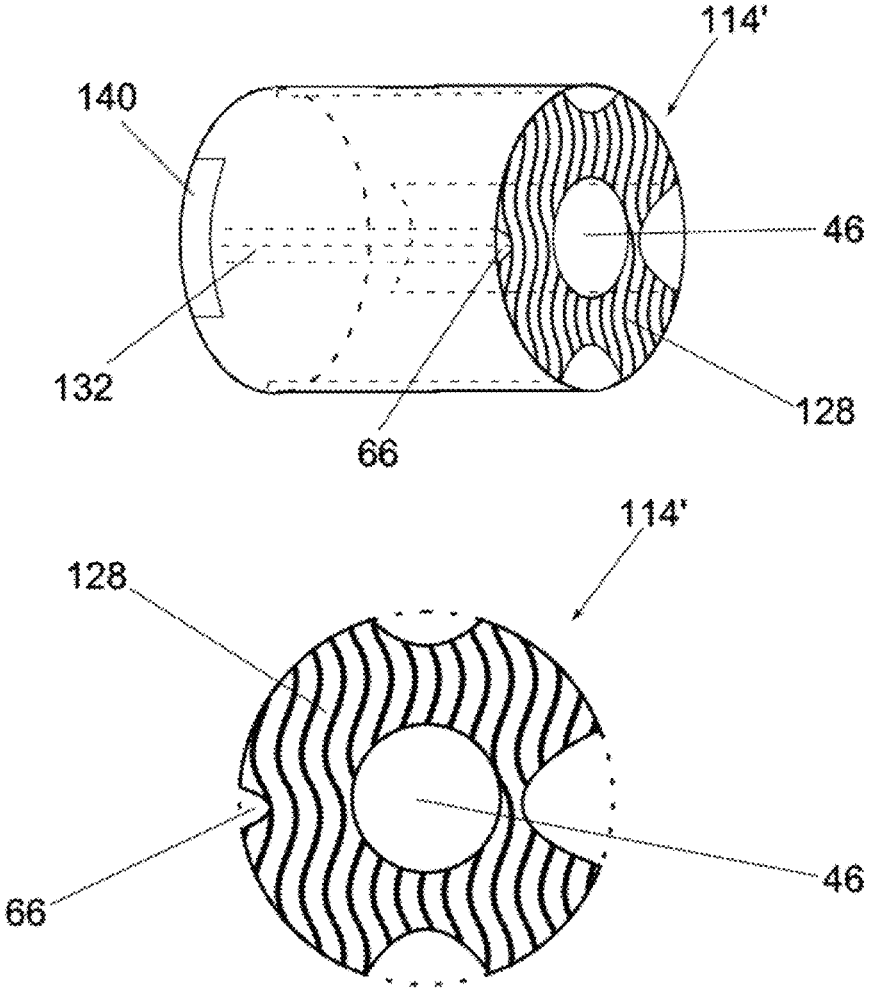
FIG. 15 shows another embodiment of a sound filter element for the mounting insert according to an embodiment of the invention.

FIG. 15 shows a second embodiment of a sound filter element 114'. The sound filter element 114' has a filter element core 128 with the core pathway 46 in its center and vent grooves 66 of different sizes on its circumference. The grooves 66 serve as vent pathways 132 to a vent pathway exit 140. The size of the vent pathway 132 can be adjusted in dependence of the orientation of the grooves 66 of the sound filter element 114'. The orientation of groove 66 in FIG. 15 shows only a small vent pathway 132. Rotation of the sound filter element 114' by 180° leads to a larger vent pathway 132 (not shown). The rotation can be possible by mechanical means, piezoelectrical means or other means. The sound filter element 114' is preferably a disposable means for sound filtering and venting.

It should be appreciated that reference throughout this specification to "one embodiment" or "an embodiment" or features included as "may" or "can" means that a particular feature, structure or characteristic described in connection with the embodiment is included in at least one embodiment of the invention. Therefore, it is emphasized and should be appreciated that two or more references to "an embodiment" or "one embodiment" or "an alternative embodiment" or features included as "may"/"can" in various portions of this specification are not necessarily all referring to the same embodiment. Furthermore, the particular features, structures or characteristics may be combined as suitable in one or more embodiments of the invention.

Throughout the foregoing description, for the purposes of explanation, numerous specific details were set forth in order to provide a thorough understanding of the invention.

Accordingly, the scope of the invention should be judged in terms of the claims which follow.

REFERENCE SIGNS

1 hearing device
10 BTE (Behind-The-Ear) unit
11 ITE (In The Ear) Unit
12 ear
13 ITE casing
14 microphone
15 Bony part
16 amplifier
18 power source
20 receiver
22 acoustic tube
24 proximal end
26 acoustic plug
28 distal end
30 concha
32 ear canal
34 mounting insert
36 ear canal cavity
38 tympanic membrane
40 dome shape part
42 core hole
44 vent hole
46 core pathway
48 core pathway projection
49 end of core pathway projection
50 venting slit
52 mounting insert cavity
54 filter bridge
56 filter bridge hole
58 filter bridge affixture
60 entrance area of the core hole
62 cavity for the acoustic tube
64 tread cavity
66 vent groove
68 outlet
70 ball joint
72 inner core part of the mounting insert
73 distal sensor
74 outer part of the mounting insert
75 processing unit
76 wax filter element
77 proximal sensor
78 inner part cavity
80 electrical lead
82 wax filter grating
84 hole of the wax filter element
86 tread at the ball joint
88 vent groove exit
90 speaker unit (receiver unit)
92 speaker tread
94 flexible speaker connection element
96 speaker unit housing
98 speaker (receiver)
100 wire
102 sleeve
104 lead
106 electrical plug
108 connector
110 acoustic tube housing tread

112 flexible acoustic tube housing
114 sound filter element
116 first filter element
118 second filter element
120 third filter element
122 fourth filler element
124 small sound transmission hole
126 bridging element
128 filter element core
130 large vent hole
132 vent pathway
134 large sound transmission hole
136 clockwise rotation direction
138 counter clockwise rotation direction

What is claimed is:

1. A hearing device, comprising:
a BTE (Behind-The-Ear) unit, which comprises
a microphone,
an amplifier,
a power source, and
a receiver and which is configured to be mounted behind or on the ear of a user; and
a thin acoustic tube having
a proximal end and a distal end where the proximal end of the thin acoustic tube is connected to the receiver of the BTE unit and the distal end is connected to a flexible mounting insert, which comprises
a dome shape part and at least one core hole permeable for sound transmitted from the thin acoustic tube through a core pathway,
wherein the thin acoustic tube is configured to be arranged in a user's ear canal to transmit sound generated by the BTE unit to a tympanic membrane of the user,
wherein a diameter of the flexible mounting insert is adapted to at least have the same diameter as an ear canal diameter of a user to close the ear canal of the user, and
wherein the flexible mounting insert comprises at least one internal vent pathway running along the core pathway and directing air in a direction substantially parallel to a length of the core pathway, that is located on the circumference of the core hole of the flexible mounting insert.

2. The hearing device according to claim 1, wherein
the at least one internal vent pathway is at least one groove in the material of a perimeter of the core hole of the flexible mounting insert.

3. The hearing device according to claim 1, wherein
the at least one internal vent pathway extends from the distal end or the proximity of the distal end of the thin acoustic tube to a proximal end of the flexible mounting insert or a proximal end of a projection of the flexible mounting insert, which encloses the internal vent pathway.

4. The hearing device according to claim 1, wherein
the flexible mounting insert comprises a wax filter element in or in front of the core hole, which is adapted to be at least partly permeable for sound transmission, to be at least partly impermeable for material and to stop wax to enter the core hole.

5. The hearing device according to claim 4, wherein
the wax filter element comprises a grating.

6. The hearing device according to claim 5, wherein
a distal side of the grating of the wax filter element comprises a coating or is at least partly of a material, which is adapted to reflect or damp sound.

7. The hearing device according to claim 1, wherein
the flexible mounting insert comprises a filter bridge element in front of or in close proximity to its core hole, which is adapted to stop wax from entering the core hole.

8. The hearing device according to claim 1, wherein
the distal end of the thin acoustic tube is a ball joint which comprises a spherical shape adapted to adjoin to the mounting insert and further comprises at least one core pathway for sound transmission.

9. The hearing device according to claim 1, wherein
the flexible mounting insert comprises at least two materials, wherein an inner core part is of a harder material than the outer part of the flexible mounting insert.

10. The hearing device according to claim 9, wherein
the inner core part comprises the at least one internal vent pathway.

11. The hearing device according to claim 9, wherein
the inner core part of the flexible mounting insert is adapted to adjoin to the ball joint, and
the ball joint is adapted to provide an articulation for the flexible mounting insert.

12. The hearing device according to claim 1, wherein
the mounting insert comprises a rotatable filter element in the core pathway, which is adjusted to transmit sound in dependence of its orientation.

13. The hearing device according to claim 12, wherein
the rotatable filter element is a sound filter element comprised of at least two consecutively arranged filter elements.

14. The hearing device according to claim 1, wherein
the flexible mounting insert and/or the thin acoustic tube comprises at least one acoustic environment sensor, which is adapted to measure parameters of the acoustic environment of the flexible mounting insert.

15. A hearing device, comprising:
a BTE (Behind-The-Ear) unit configured to be mounted behind or on the ear of a user, including
a microphone,
an amplifier, and
a power source;
a receiver unit including a receiver; and
a lead connecting the amplifier of the BTE unit with the receiver, the lead having
a proximal end and a distal end where the proximal end of the lead is connected to the BTE unit and the distal end is connected to the receiver, wherein
the receiver is configured to be arranged in an ear canal of the user,
the receiver is enclosed in the receiver unit, and
the receiver is configured to generate sound to be transmitted to a tympanic membrane of the user,
the receiver unit is connected to a flexible mounting insert having
a dome shape part,
at least one core hole permeable for sound transmitted from the receiver, and
a core pathway extending through the receiver unit,
a diameter of the flexible mounting insert is adapted to at least have the same diameter as an ear canal diameter of the user to close the ear canal of the user, and
the flexible mounting insert comprises at least one internal vent pathway running along the core pathway and directing air in a direction substantially parallel to a length of the core pathway and is located on the circumference of the core hole of the flexible mounting insert.

16. The hearing device according to claim 2, wherein the at least one internal vent pathway includes a plurality of grooves in the material of the perimeter of the core hole of the flexible mounting insert.

17. The hearing device according to claim 16, comprising:

four grooves in the material of the perimeter of the core hole of the flexible mounting insert.

18. The hearing device according to claim 17, wherein said four groves are equally distributed around the perimeter of the core hole of the flexible mounting insert.

19. The hearing device according to claim 15, wherein the at least one internal vent pathway is at least one groove in the material of a perimeter of the core hole of the flexible mounting insert.

20. The hearing device according to claim 19, wherein the at least one internal vent pathway includes a plurality of grooves in the material of the perimeter of the core hole of the flexible mounting insert, and said plurality of groves are equally distributed around the perimeter of the core hole of the flexible mounting insert.

* * * * *